US008146621B2

(12) United States Patent
Bruske et al.

(10) Patent No.: US 8,146,621 B2
(45) Date of Patent: Apr. 3, 2012

(54) METAL HEALD FRAME AND HEALD SHAFT FOR A LOOM

(75) Inventors: Johannes Bruske, Albstadt (DE); Günther Büchle, Bad Waldsee (DE)

(73) Assignee: Groz-Beckert KG, Albstadt (DE)

( * ) Notice: Subject to any disclaimer, the term of this patent is extended or adjusted under 35 U.S.C. 154(b) by 1356 days.

(21) Appl. No.: 10/539,293

(22) PCT Filed: Dec. 10, 2003

(86) PCT No.: PCT/EP03/13972

§ 371 (c)(1),
(2), (4) Date: Jun. 16, 2005

(87) PCT Pub. No.: WO2004/057077

PCT Pub. Date: Jul. 8, 2004

(65) Prior Publication Data

US 2006/0048836 A1 Mar. 9, 2006

(30) Foreign Application Priority Data

Dec. 19, 2002 (DE) ..... 102 60 075

(51) Int. Cl.

| | |
|---|---|
| ***D03C 9/00*** | (2006.01) |
| ***D03C 9/02*** | (2006.01) |
| ***D03C 9/04*** | (2006.01) |
| ***D03C 9/06*** | (2006.01) |
| *D03C 13/00* | (2006.01) |

(52) U.S. Cl. ..... 139/55.1; 139/57; 139/30; 139/73; 139/74; 139/88

(58) Field of Classification Search ..... 139/57, 139/30, 73, 74, 76, 88, 55.1
See application file for complete search history.

(56) References Cited

U.S. PATENT DOCUMENTS

| | | | | | |
|---|---|---|---|---|---|
| 3,071,164 | A | * | 1/1963 | Nussbaum | 139/92 |
| 4,091,844 | A | * | 5/1978 | Underwood | 139/91 |
| 4,106,529 | A | * | 8/1978 | Kaufmann | 139/92 |
| 4,106,530 | A | * | 8/1978 | Kaufmann | 139/92 |
| 4,227,553 | A | * | 10/1980 | Schwarz | 139/82 |
| 4,342,339 | A | * | 8/1982 | Koch | 139/93 |
| 4,476,900 | A | * | 10/1984 | Bowen | 139/91 |
| 4,790,357 | A | * | 12/1988 | Kramer | 139/91 |
| 5,152,325 | A | * | 10/1992 | Koch | 139/91 |
| 5,462,093 | A | * | 10/1995 | Froment | 139/57 |

(Continued)

FOREIGN PATENT DOCUMENTS

| | | | |
|---|---|---|---|
| DE | 30 21 163 A | | 4/1981 |
| DE | 3021163 A | * | 4/1981 |
| DE | G9413705.6 U1 | | 12/1994 |

(Continued)

*Primary Examiner* — Bobby Muromoto, Jr.
(74) *Attorney, Agent, or Firm* — Fitch Even Tabin & Flannery LLP; Norman N. Kunitz

(57) ABSTRACT

A heddle shaft (1) with heddles (3) that are supported with little play or free of play has at least one heddle support rail (7), which is supported movably for elastically tensing the heddles (3) as a whole, or has at least one movably supported part (55). A spring means (16, 56) serves to exert a tensing force on the heddle head (5) of each heddle (3) for supporting that heddle without play. This makes a high operating speed of a power loom, provided with such a heddle shaft, possible without the heddles digging into the heddle support rails and without producing excessive noise.

8 Claims, 4 Drawing Sheets

U.S. PATENT DOCUMENTS

| | | | | |
|---|---|---|---|---|
| 5,645,111 | A * | 7/1997 | Lindblom | 139/55.1 |
| 5,816,294 | A * | 10/1998 | Speich | 139/91 |
| 5,944,061 | A * | 8/1999 | Eriksson | 139/66 R |
| 6,009,918 | A * | 1/2000 | Beyaert | 139/92 |
| 6,789,580 | B1 | 9/2004 | Cardoen et al. | |
| 7,032,624 | B2 * | 4/2006 | Bruske et al. | 139/57 |
| 7,204,274 | B2 * | 4/2007 | Mettler | 139/93 |
| 7,322,383 | B2 * | 1/2008 | Gesing | 139/89 |

FOREIGN PATENT DOCUMENTS

| | | | |
|---|---|---|---|
| DE | 199 62 977 | A1 | 9/2001 |
| EP | 0 302 798 | A | 2/1989 |
| EP | 0 874 930 | A | 11/1998 |
| EP | 1 176 237 | A | 1/2002 |
| JP | 56-53236 | A | 12/1981 |
| WO | WO-97 26396 | A | 7/1997 |

* cited by examiner

METAL HEALD FRAME AND HEALD SHAFT FOR A LOOM

CROSS REFERENCE TO RELATED APPLICATION

This application is the National Stage filing under 35 U.S.C. 371 of International Application No. PCT/EP2003/013972, filed Dec. 10, 2003, and claims priority of German Patent Application Number 102 60 075.9, filed Dec. 19, 2002, which is incorporated herein, in its entirety, by reference.

BACKGROUND OF THE INVENTION

The invention relates to a shaft frame, particularly for power looms.

The shaft (also called a heddle shaft) of a power loom is formed by a shaft frame, on which heddles are retained. Each of the heddles has an eyelet for a warp yarn passing through it. A motion of the shaft in the longitudinal direction of the heddles therefore shifts the warp yarns out of the plane of the warp yarn, forming a shed, for instance for inserting a weft yarn.

In modern power looms, the heddle shafts are moved back and forth at high speed. The accelerations and braking forces are so great that the heddles, which as a rule are held with some play on the shaft frame, hit their bearings and dig in there. This process generates noise and wear and puts limits on the operating speed of a power loom.

The attempt has therefore already been made to reduce the play of the heddles on the shaft frame. To that end, German Utility Model G 94 13 705 proposes providing a narrowly dimensioned transverse groove on the heddle head of each heddle, and a jiblike protrusion of a driving support rail, which is part of the shaft frame, belongs in this groove. However, the prerequisite for this is suitable adaptation of the heddle heads. Moreover, forces introduced into the heddle head relatively at only individual points.

From German Patent Disclosure DE 199 62 977 A1, it is known to dispose a strip of a material with damping properties on a flank, facing toward the heddle heads, of a shaft frame in order to embody a yielding stop. This stop is subject to wear when the heddle heads periodically strike it.

From European Patent Disclosure EP 0 874 930 B1, it is known to secure heddles to the heddle frame without play. To that end, a heddle support rail that reaches through the heddle heads has an expandable element, which is formed for instance by a hose that can be subjected to a fluid. In the non-expanded state, the heddle heads can be slipped onto the heddle support rail. If the element is expanded by subjection to fluid, then the heddle head is firmly clamped to the heddle support rail. It is thus seated without play.

This embodiment is relatively complicated and expensive.

With the above as the point of departure, it is the object of the invention to create a heddle shaft which, at little effort and expense and with high reliability makes an increased operating speed of power looms possible.

SUMMARY OF THE INVENTION

The above object generally is achieved by the shaft frame of the invention, wherein the heddle support rail is either resiliently supported as a whole, or it has at least one resiliently supported portion for receiving one or more heddles at their heddle heads. As a result, the heddle can be held in a prestressed fashion. The prestressing can be absorbed either only within the heddle head, in which case the heddle is retained without force in the state of repose, or force can alternatively be exerted via the heddle because the heddle is tensed, by means of the resiliently supported heddle support rail or by its resiliently supported portion, as a whole against the diametrically opposite heddle support rail. The latter is preferred, because the tensile force constantly exerted on the heddle and originating in the spring means of the heddle support rail in a sense reinforces the heddle. The heddles are therefore securely held as a whole without play on the shaft frame, so that even at high operating speeds, no hitting or clattering occurs. Moreover, heddles that are not as kink-resistant can be employed. If needed, however, a stiffening of the heddles is additionally possible, by providing them with a longitudinally extending edge or channel.

The heddle support rail, in a first embodiment, may be embodied rigidly and prestressed as a whole against the heddle frame by a spring means in a direction that matches the longitudinal direction of the heddle. This prestressing avoids play and causes the heddle, upon its transmission of force from the heddle frame to the warp yarn, to remain always stressed with tension. The force that this prestressing generates can be generated by a pneumatic device, a hydraulic device, or a spring.

In an advantageous embodiment, the spring means and/or the heddle support rail is assigned an adjusting device, which is arranged to block the action of the spring means. When the adjusting device is activated in this way, it locks the heddle support rail in a predetermined position. This position is preferably selected such that the heddles are laterally freely displaceable on the heddle support rails. In other words, in this state, the support rail spacing essentially matches the heddle head spacing, and the heddle support rails are undersized, relative to the opening in the heddle head. Conversely, if the adjusting device is opened far enough that the spring means becomes operative, then the spacing of the heddle support rails from one another increases so greatly that the existing play at both heddle heads disappears, and the heddle is kept tensed. Alternatively, in an embodiment in which only part of a heddle support rail is supported movably and is prestressed by a spring, the play can be eliminated solely at one heddle head. It is furthermore possible, including in this version, for the movably supported part of the heddle support rail to be used for tensing the heddles as a whole.

The heddle support rail may have two spring legs pointing away from one another and embodied on the order of lips, which on resiliently yielding execute a pivoting motion. In this version, as in a version with a split heddle support rail whose parts are tensed against one another, a play-free reception of the heddle head can be accomplished. This embodiment has the advantage that variations in terms of the width of heddle heads of adjacent heddles can also be compensated for. This is especially applicable if the parts are embodied of quite thin material and at adjacent points can thus be deflected resiliently outward to different extents.

In the embodiment in which the heddle support rail is rigidly embodied and is prestressed as a whole against the heddle frame by spring means, it may be advantageous if the heddle head has an integrated spring means. As a result, production variations in the manufacture of the heddle head can be compensated for, thus assuring that all the heddle heads are tensed under tensile force.

It is preferable to connect the shaft frame to a drive means, such as a lever mechanism, at at least three drive points spaced apart from one another. The drive points are located over the length of a crossbeam extending parallel to a heddle support rail. The drive points are preferably selected such that the sagging of the crossbeam under dynamic load is minimized.

The resiliently supported or resiliently embodied heddle support rail is preferably disposed on the side of the shaft frame located diametrically opposite the drive points. The rigid support of the heddles is thus effected on the rigid part of the shaft frame, which because the introduction of force is distributed over a plurality of drive points is subject to only slight deformation. The diametrically opposite shaft frame portion (or crossbeam), which is joined only by its two ends, via suitable struts, to the first crossbeam mentioned above, may be subject to somewhat greater deformation as a consequence of dynamic loading. However, this deformation is readily compensated for by the resilient heddle support rail or its resilient suspension. As a whole, this feature likewise contributes to increasing the possible operating speed of an applicable power loom.

If the spring means is part of the heddle support rail, so that the heddle support rail is embodied resiliently as a whole or has at least one resiliently supported portion, then the ratio of the dimensions of the heddle support rail to the opening of the heddle head can also be made such that the heddle head sits with only slight play on the heddle support rail. The resilient embodiment of the heddle support rail or the resilient supporting of parts of it can be utilized in this case to damp the impacts of the heddle head on the heddle support rail in the reciprocating motion of the heddle shaft and thus make it largely harmless.

Further details of advantageous embodiments of the invention are the subject of the drawings, description, or dependent claims. Exemplary embodiments of the invention are shown in the drawings.

DETAILED DESCRIPTION OF THE INVENTION

Figure 1:
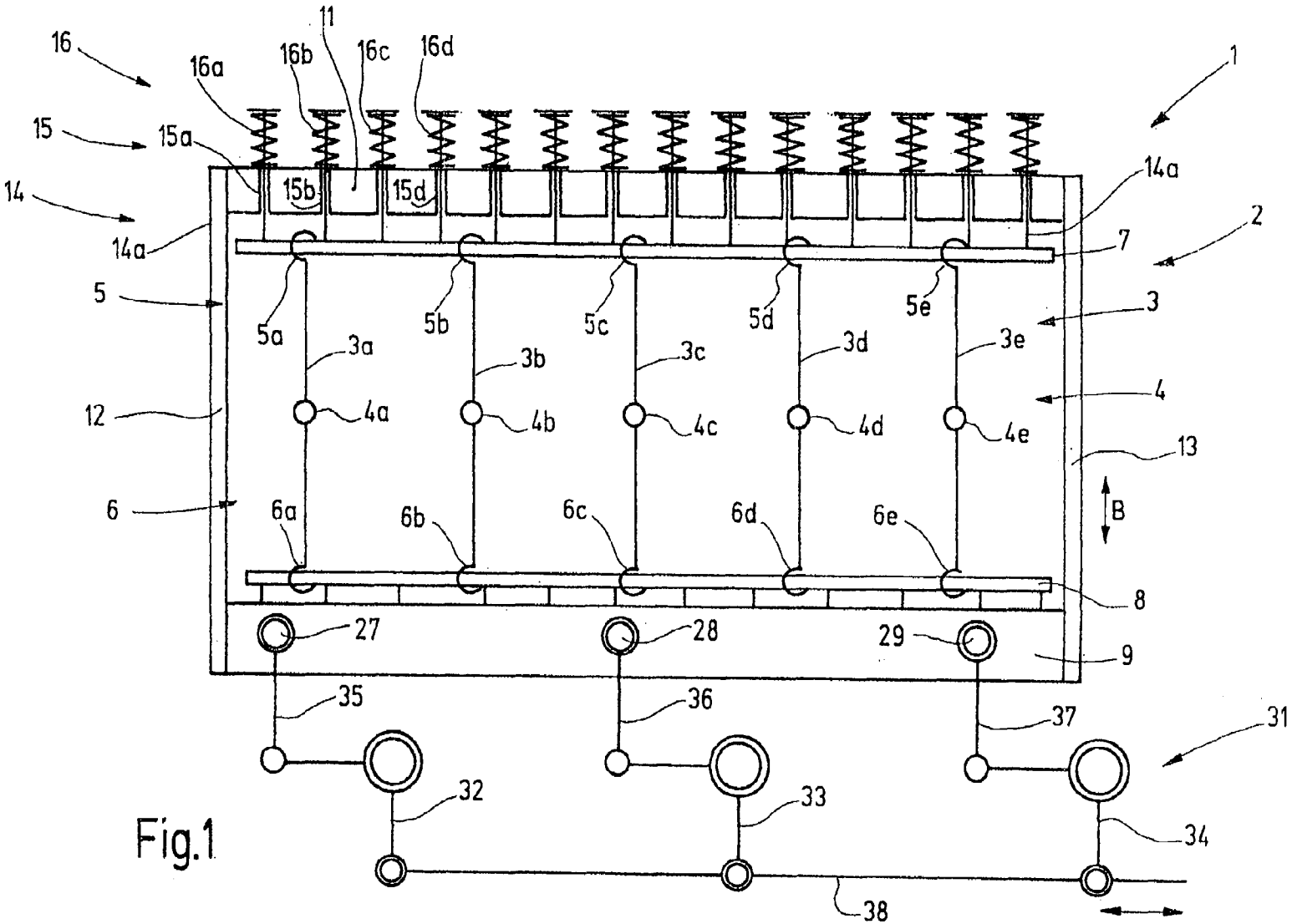
FIG. 1 is a schematic view of a heddle shaft with a drive mechanism.

FIG. 1 shows a heddle shaft 1 of a power loom, not further shown. The heddle shaft 1 includes a shaft frame 2, which carries a plurality of heddles 3 disposed parallel to one another. For purposes of illustration, FIG. 1 shows only five individual heddles 3*a*, 3*b*, 3*c*, 3*d*, 3*e*. In actuality, there are a greater number of heddles, at closer spacings. Each heddle 3, approximately in its middle, has an eyelet 4 (4*a*, 4*b*, 4*c*, 4*d*, 4*e*), through each of which a respective warp yarn passes. Each heddle 3 is provided on each end with a heddle head 5, 6 (5*a*, 5*b*, 5*c*, 5*d*, 5*e*; 6*a*, 6*b*, 6*c*, 6*d*, 6*e*), with which the heddles 3 are retained on heddle support rails 7, 8. The heddle support rails 7, 8 are supported by the shaft frame 2 and extend spaced apart and parallel to one another transversely to a direction of motion B of the shaft frame 2, which matches the longitudinal direction of the heddles 3. The heddle support rail 8 is retained rigidly on the shaft frame 2, which frame comprises a lower crossbeam 9, an upper crossbeam 11, and two lateral props 12, 13 that join the ends of the crossbeams 9, 11 and extend in the direction of motion B.

The heddle support rail 7 is located in the immediate vicinity of the crossbeam 11 and is supported movably relative to it in the direction of motion B. This purpose is served by a series of traction elements 14 (14*a* through 14*n*), which extend through the crossbeam 11, each through a suitable guide opening 15 (15*a* through 15*n*). The traction elements 14 are each tensed against the crossbeam 11 by a respective spring means 16 (16*a* through 16*n*) in the form of a compression spring. The direction of action of the spring means 16 is such that the heddle support rail 7 is tensed toward the crossbeam 11 and away from the crossbeam 9 and the other heddle support rail 8.

Figure 2:
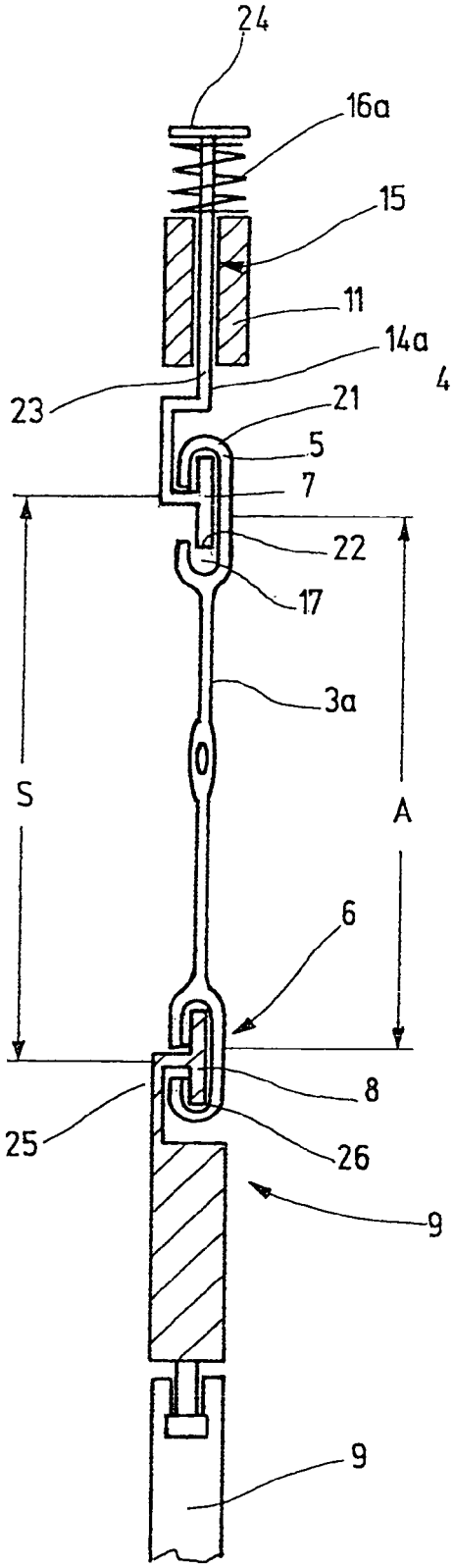
FIG. 2 is a schematic cross section through the heddle shaft of FIG. 1.

The embodiment of the heddle shaft 1 can also be seen from the sectional view in FIG. 2. The section is made in the immediately vicinity of the prop 12. The traction element 14*a*, the heddle 3*a*, and the spring means 16*a* conceal the respective traction elements, heddles and spring means located behind them. All of each kind of these elements are embodied identically, so that the description below applies equally to all the elements identified by letters a through e and a through n as applicable.

The heddle head 5 is embodied as C-shaped in cross section. It embraces an elongated oval opening 17, whose edge is open on one side 18. The heddle support rail 7 seated in the opening 17 has a rectangular cross section. It may be rounded off as needed on its top 21 and on its underside 22. It is made of steel or aluminum, for instance, and extends over the entire width of the shaft frame 2, as seen in FIG. 1.

Approximately in the middle, that is, halfway up its height, the traction elements 14 are attached to the heddle support rail 7. They are formed by flat or round profile sections, for instance, which extend initially at a right angle away from a flat side of the heddle support rail 7. They are disposed such that the heddle head 5 cannot get into contact with them. At an adequate distance from the heddle support rail 7, the profile section is bent sharply upward and extends in the direction of the crossbeam 11. Above the heddle support rail 7, the traction element 14 is bent at a right angle again, so that a leg 23, extending through the guide opening 15, is located in the same plane with the heddle support rail 7. The leg 23 is thus aligned with the heddle 3. On its end, the leg 23 has a pressure plate 24. The spring means 16 is braced between this pressure plate and the crossbeam 11.

The heddle head 6 is seated on the heddle support rail 8, which is embodied as a steel profile section of rectangular cross section and whose top and underside are preferably rounded. The edge surrounding the opening in the heddle head 6 is laterally open, so that a mounting portion 25, protruding laterally away from the heddle support rail 8, has no contact with the heddle head 6.

The spacing between the top 21 of the heddle support rail 7 and the underside 26 of the heddle support rail 8, when the spring means 16 is relaxed, is somewhat greater than the spacing, defined by the heddle 3, between the upper inside of the heddle head 5 and the lower inside of the heddle head 6. If the middles of the heddle support rails 7 and 8 are taken as a measure of the heddle support rail spacing, and the middles of the heddle heads 5, 6 are taken as a measure for the length of the heddles, the support rail spacing S exceeds the heddle head center spacing A (see FIG. 2).

Figure 8:
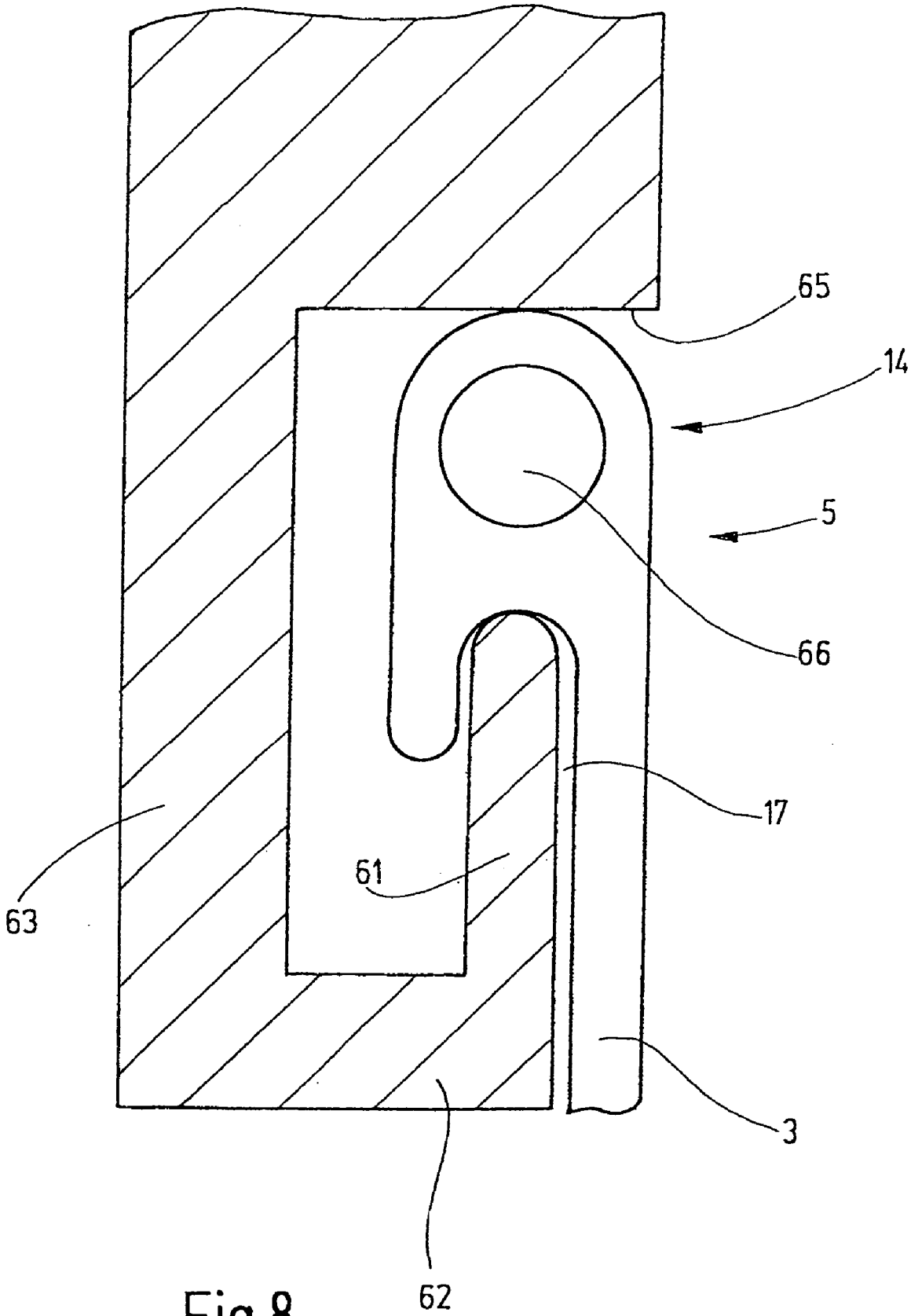
FIG. 8 is an enlarged detail of a heddle support rail with a weaving heddle with an integrated spring means in the head of the weaving heddle.

The heddle 3 shown in FIG. 8, which comprises a flat material, extends between the heddle support rails 7, 8 in the form of a flat strip. On at least one end, for instance the upper end, the heddle 3 has a heddle head 5 that serves to secure the heddle 3 to the heddle support rail 7. The heddle head 5 has a jawlike opening 17, pointing in the direction of motion B of the heddle 3, with which the heddle 3 is held on a jib 61, which is joined preferably integrally to the upper heddle support rail 7. The jib 61 has a rib, protruding upward in the longitudinal direction B of the heddle 3, which is joined via a crosspiece 62 to an extension 63, oriented parallel to the jib 61, of the heddle support rail 7. On its top, the jib 61 is rounded. The jawlike opening 17 of the heddle head 5 is likewise rounded in this region.

A spring means 14 is embodied on the side of the heddle head 5 facing away from the opening 17, and with this spring means the heddle head 5 is braced on a pressure face 65 located diametrically opposite the jib 61. The pressure face 65 is embodied for instance on the heddle support rail 7.

The spring means 64 is formed for instance by a portion of the heddle head 5 that is provided with an opening 66, which extends through the heddle head 5, crosswise to the direction of motion of the heddle. This portion extends adjacent to the recess 17 and is preferably of the same material as the rest of the heddle head. Because of the spring means 64, the heddle head 5 and thus the heddle 3 are clamped to the heddle support rail 7 without play.

Still other embodiments of the spring means 64 are possible. What is decisive is that the heddle 3 is resiliently clamped to the heddle support rail 7, 8.

As can be seen from FIG. 1, the lower crossbeam.9 is joined at three drive points 27, 28, 29 to a drive mechanism 31, which in the present exemplary embodiment is formed by a lever mechanism with three bell crank levers 32, 33, 34 and connecting-rod-like rods 35, 36, 37 that transmit thrust and traction. The rods 35, 36, 37 connect the bell crank levers 32, 33, 34 to the drive points 27, 28, 29. The drive points 27, 28, 29 are disposed such that the segments of the crossbeam 9 that border on the drive points 27, 28, 29 deform approximately equally in terms of amount. The other ends of the bell crank levers 32, 33, 34 are pivotably connected to a common drive rod 38, whose reciprocating motion moves the heddle shaft 1 in the direction of motion B.

The heddle shaft 1 described thus far functions as follows:

Once the heddle shaft 1 is equipped with all the heddles 3, these heddles are tensed between the heddle support rails 7, 8. The heddle support rail 7 rests with its top 21 on the corresponding inner throat of the heddle head 5. The spring means 16 tenses the heddle support rails 7 against the heddle head 5. With its other heddle head 6, the heddle 3 is retained on the heddle support rail 8, where it is pressed, with the inside of its head opening, against the underside 26 of the heddle support rail 8. When the heddle shaft is then, by means of its drive mechanism 31, accelerated upward, braked again, brought to a standstill, accelerated downward, braked again, and again brought to a standstill, all in rapid succession, the spring means 16 exert a tensile force on the heddles 3 that is greater than the incident acceleration forces that engage the heddle support rail 7. As a result, the heddle heads 5, 6 are kept in constant contact with the heddle support rails 7, 8. The heddles do not clatter. Because the force is introduced at three or more points, the lower crossbeam 9 experiences only an extremely slight deformation. A dynamic deformation of the upper crossbeam 11, because of the decoupling by the spring means 16, is transmitted to the heddle support rail 7. As a result, compared to other versions, the precision of the positioning of the heddles at high operating speeds is increased.

Figure 3:
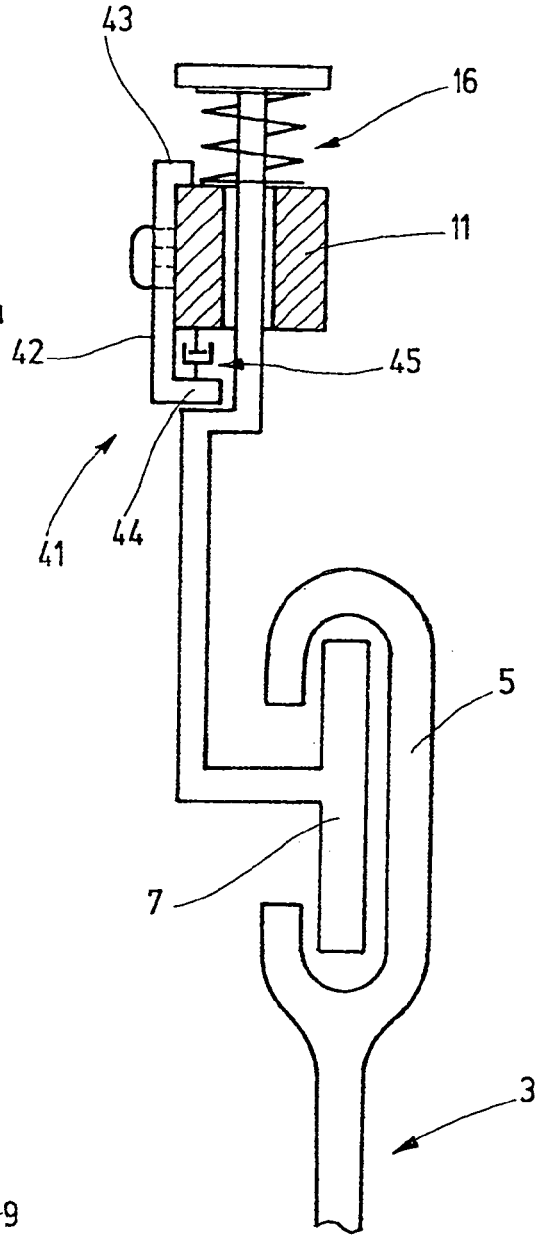
FIG. 3 is a detail in section of the heddle shaft of FIG. 2.

In the embodiment presented, the heddles 3 are slipped with tension onto the heddle support rails 7, 8, when the heddle shaft 1 is being equipped heddles 3. In an advantageous embodiment, schematically represented in FIG. 3, the spring means 16 can conversely be deactivated, to enable slipping the heddles 3 onto the support rails 7, 8 with play. To that, a locking device 41 is provided, with which the heddle support rail 7 can be locked in a position of repose. The position of repose is defined such that the support rail spacing S approximately matches the heddle head spacing A. For instance, the locking device may be formed by a pressure rail 42, which supported vertically displaceably, that is, in the direction of motion B, on the crossbeam 11. Otherwise, it extends over the entire length of the heddle support rail 7. The pressure rail 42 may have an upper protrusion 43, which acts as a stop means for defining a terminal position of the pressure rail. A lower protrusion 44 can serve to press the traction element 14 downward at its right-angle-bend point, counter to the force of the spring means 16, in order to keep the spring means 16 tensed. An adjusting device 45, for instance in the form of a screw, an eccentric device, a wedge gear, or as shown a fluid-actuated expansion element, can serve to move the pressure rail 42 downward in a controlled fashion, so as to lock the heddle support rail 7 in the lower position. If the adjusting device 45 is deactivated, the motion of the heddle support rail is released again, and the spring means 16 can tense the heddles 3.

In this embodiment, it is possible for the power loom to start up first with the heddles not tensed and optionally at reduced operating speed, so that all the heddles 3 are freely movable laterally. They then gradually assume their operating position on their own. Once the loom has run up to speed enough, the adjusting device 45 can be deactivated, making the spring means 16 operative. The heddles are then firmly clamped, each at its own place, after which the operating speed of the power loom can be increased to the extent desired, without clattering of the heddles and without their striking the shaft frame.

Figure 4:
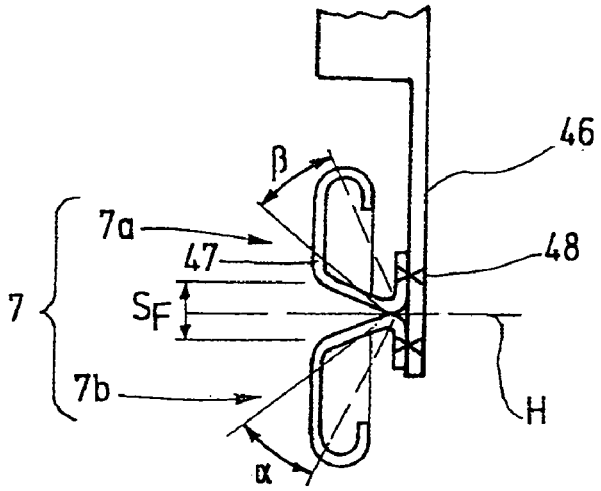
FIG. 4 is a modified embodiment of a heddle support rail for a heddle shaft.
Figure 5:
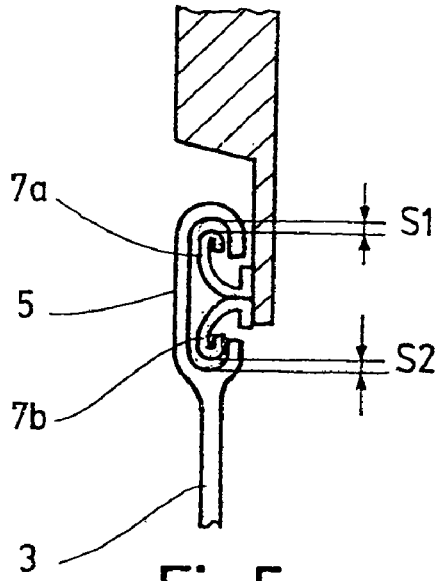
FIG. 5 shows the drive point of FIG. 4 with a heddle supported on it.

FIGS. 4 and 5 show a modified embodiment of the heddle shaft 1 in terms of the upper heddle support rail 7. In contrast to the foregoing exemplary embodiment, this heddle support rail is not rigid but instead is intrinsically flexible. To that end, as can be seen from FIG. 4, it is formed by two spring rails 7*a*, 7*b*, bent into the shape of a C, which are embodied symmetrically to one another relative to a horizontal plane H. At the top, the spring rail 7*a* has a U-shaped portion, as a contact region, whose leg 47 located away from a beam region 46 extends toward the plane of symmetry H. Before reaching this plane, the leg 47 is bent at an obtuse angle toward the beam region 46. The end of this leg 47 is then bent once more, causing it to rest flatly on the plane beam region 46. As a result, the region of the leg 47 adjoining the U-shaped portion extends parallel to the beam region 46. At a connecting point 48, the leg 47 is joined, for instance welded, to the beam region 46.

The support rail portions 7*a*, 7*b* are embodied on the order of resilient lips and can pivot at an acute angle $\alpha$, $\beta$, each approximately 10° to 30° (depending on the embodiment). The dimensioning is made such that the undeformed heddle support rail 7, as FIG. 5 shows, receives the heddle head 5 with very slight play S1, S2. The play, which is preferably in the range of less than 1 mm, is so slight that even at high operating speeds, excessive noises do not occur. The flexible support rail portions 7*a*, 7*b* act as resilient buffers and thus protectively absorb impacts and shocks upon acceleration and braking of the heddles 3.

Figure 6:
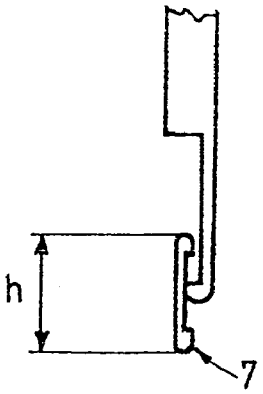
FIG. 6 shows a further embodiment of a heddle support rail.
Figure 7:
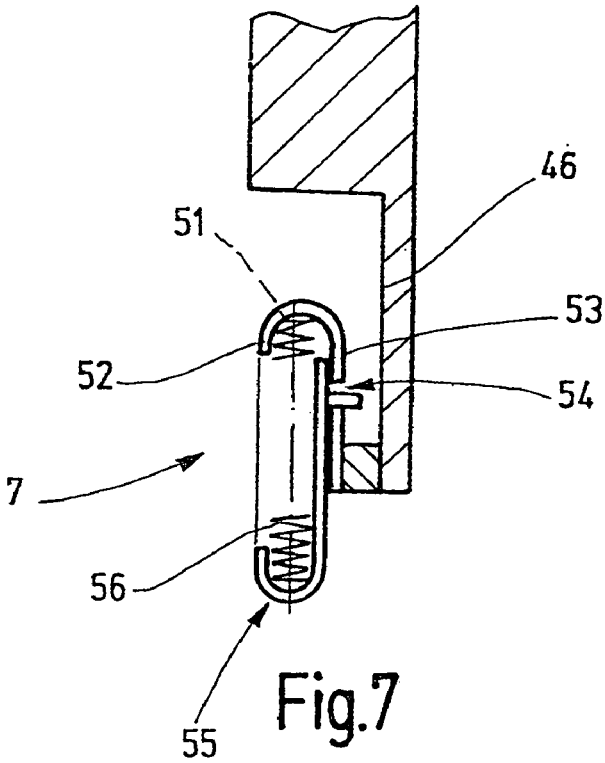
FIG. 7 shows an enlarged sectional view of the heddle support rail of FIG. 6.

Alternatively, the heddle support rail 7 may be embodied as in FIGS. 6 and 7. While FIG. 6 shows this in approximately the actual size, FIG. 7 shows the internal construction. This heddle support rail 7 has an upper part 51 supported rigidly on the beam region 46. This part is approximately U-shaped in cross section, with one short leg 52 and one long leg 53. The long leg 53 is retained spaced apart from and parallel to the beam part 46. The part 51 thus forms an asymmetrical U-shaped channel. Openings 54 are made in the long leg 53, through which openings an extension of a second part 55 extends. This second part is likewise asymmetrical and U-shaped. The extension is seated with play in the opening 54, so that the part 55 is movable up and down relative to the part 51 with a certain limited play. A compression spring 56 is seated, if possible with prestressing, between the parts 51, 55. The outer contour, that is, the height h shown in FIG. 7 of the heddle support rail 7 formed in this way is preferably somewhat greater than the internal width of the opening of a heddle head 5. Alternatively, a very slight play may be provided, which just barely still permits the lateral displacement of the heddle heads on the heddle support rail 7 but is so slight that the heddle heads do not clatter on the support rail 7.

The heddle support rails 7 in FIGS. 4 through 7 implement the fundamental concept of the tensed reception of a heddle head without tensing of the heddle. The respective spring means in the form of the support rail portions 7*a*, 7*b* (spring legs) or of the compression spring 56 is braced completely on the heddle head 5. By comparison, the spring means 16 tenses the heddle against the other heddle support rail 8. This can also be achieved with the embodiment of FIG. 5 or FIG. 7, if the ratio between the support rail spacing S and the heddle head spacing A is mentioned as shown in FIG. 2. To that end, the heddle support rail 7 of FIG. 7 is rotated to a certain extent; that is, the rigidly supported part 51 points downward, and the movably supported part 55 points upward, in order to tense the heddle 3 as a whole.

A heddle shaft 1 with heddles 3 that are supported with little play or free of play has at least one heddle support rail 7, which is supported movably for elastically tensing the heddles 3 as a whole, or has at least one movably supported part 55. A spring means 16, 56 serves to exert a tensing force on the heddle head 5 of each heddle 3 for supporting that heddle without play. This makes a high operating speed of a power loom, provided with such a heddle shaft, possible without the heddles digging into the heddle support rails and without producing excessive noise.

List of Reference Numerals:

| | |
|---|---|
| 1 | Heddle shaft |
| 2 | Shaft frame |
| 3 | Heddles (3a through 3e) |
| 4 | Eyelet (4a through 4e) |
| 5, 6 | Heddle head (5a through 5e; 6a through 6e) |
| 7, 8 | Heddle support rails |
| 7a, 7b | Support rail portions |
| 9, 11 | Crossbeams |
| 12, 13 | Props |
| 14 | Traction elements (14a through 14n) |
| 15 | Guide opening (15a through 15n) |
| 16 | Spring means (16a through 16n) |
| 17 | Opening |
| 18 | Side |
| 21, 22 | Top/underside |
| 23 | Leg |
| 24 | Pressure plate |
| 25 | Mounting portion |
| 26 | Underside |
| 27, 28, 29 | Drive points |
| 31 | Drive mechanism |
| 32, 33, 34 | Bell crank levers |
| 35, 36, 37 | Rods |
| 38 | Drive rod |
| 41 | Locking device |
| 42 | Pressure rail |

List of Reference Numerals:-continued

| | |
|---|---|
| 43, 44 | Protrusion |
| 45 | Adjusting device |
| 46 | Beam region |
| 47 | Leg |
| 48 | Connecting point |
| 51 | Part |
| 52, 53 | Legs |
| 54 | Openings |
| 55 | Part |
| 56 | Compression spring |
| 61 | Jib |
| 62 | Crosspiece |
| 63 | Extension |
| 64 | Spring means |
| 65 | Compression spring |
| B | Direction of motion |
| S | Support rail spacing |
| A | Heddle head spacing |
| H | Horizontal plane |
| h | Height |
| S1, S2 | Play |
| α, β | Angles |

The invention claimed is:

1. A shaft frame, for power looms, having at least one heddle support rail, which is resiliently supported or has a resiliently supported portion, for receiving one or more heddles by extending into a single end eyelet of each heddle; and wherein:

the at least one heddle support rail is supported in a stationary fashion on the frame and is formed as two support rail portions, embodied as resilient spring legs, pointing away from one another.

2. A shaft frame, for power looms, having at least one heddle support rail, which is resiliently supported or has a resiliently supported portion, for receiving one or more heddles by extending into a single end eyelet of each heddle; and wherein the at least one heddle support rail is formed of two diametrically opposed receiving jibs, which are tensed resiliently away from one another, in order to receive heddle heads without play by extending into a respective heddle end eyelet of a respective heddle.

3. A shaft frame, for power looms, having at least one heddle support rail, which is resiliently supported or has a resiliently supported portion, for receiving one or more heddles by extending into a single end eyelet of each heddle; and wherein the at least one heddle support rail is formed of two diametrically opposed parts embodied as receiving jibs for a single end eyelet of heddle heads, of which one jib is supported rigidly on a beam connected to the frame and the other jib is supported movably on the beam counter to at least one spring element.

4. The shaft frame according to claim 1 wherein the shaft frame is joined to a drive means at at least three drive points, spaced apart in the transverse direction relative to the direction of motion from one another.

5. The shaft frame according to claim 2, wherein the shaft frame is joined to a drive means at at least three drive points, spaced apart in the transverse direction relative to the direction of motion from one another.

6. The shaft frame according to claim 3, wherein the shaft frame is joined to a drive means at at least three drive points, spaced apart in the transverse direction relative to the direction of motion from one another.

7. The shaft frame according to claim 1, wherein each of the spring legs is generally C-shaped and both spring legs are disposed symmetrically to one another relative to a horizontal plane.

8. The shaft frame according to claim 3, wherein each of the jibs are generally U-shaped with one longer leg that is supported on the beam, and the spring means is a compression spring.

* * * * *